US006709299B2

(12) United States Patent
Listing et al.

(10) Patent No.: US 6,709,299 B2
(45) Date of Patent: Mar. 23, 2004

(54) PLUG-IN MODULE, CARRIER PLATE AND RELAY ARRANGEMENT

(75) Inventors: Martin Listing, Dreieich (DE); Frank-Stephan Niebler, Viernheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/075,723

(22) Filed: Feb. 14, 2002

(65) Prior Publication Data

US 2002/0142670 A1 Oct. 3, 2002

(30) Foreign Application Priority Data

Feb. 16, 2001 (DE) ..... 101 07 213

(51) Int. Cl.[7] ..... H01R 9/22
(52) U.S. Cl. ..... 439/709; 439/762
(58) Field of Search ..... 439/709, 76.2, 439/701

(56) References Cited

U.S. PATENT DOCUMENTS 5,038,050 A 8/1991 Minoura ..... 307/10.1
5,179,503 A 1/1993 Fouts et al. ..... 361/729
5,295,870 A * 3/1994 Rei et al. ..... 439/717
6,196,882 B1 * 3/2001 Sato et al. ..... 439/701

FOREIGN PATENT DOCUMENTS

| | | | |
|---|---|---|---|
| DE | 19745857 A1 | 4/1998 | ..... H01H/85/26 |
| EP | 0 135 910 A2 | 4/1985 | ..... H01R/13/64 |
| EP | 0 829 926 A2 | 3/1998 | ..... H01R/13/436 |
| FR | 2 742 004 | 6/1997 | ..... H01R/13/506 |

OTHER PUBLICATIONS

European Search Report Sep. 2002.

* cited by examiner

*Primary Examiner*—Tulsidas Patel

(57) ABSTRACT

A relay box having a carrier plate and a plug-in module is disclosed. A conductor to be switched is brought into electrical contact with a relay through the plug-in module and a plug contact arranged in the plug-in module. The relay is plugged both into the plug-in module and into the carrier plate of the relay box through plug contacts. Because of the modular arrangement, increased flexibility is possible when using a prefabricated carrier plate having terminal positions provided for a plurality of relays.

14 Claims, 8 Drawing Sheets

A–A

PLUG-IN MODULE, CARRIER PLATE AND RELAY ARRANGEMENT

FIELD OF THE INVENTION

The invention relates to a modular relay arrangement with a plug-in module having a first terminal element, a second terminal element and a plug position for a fuse.

BACKGROUND OF THE INVENTION

Relay arrangements are used in a variety of ways in electrical circuit arrangements. Relay arrangements are known in which the relay is plugged into a carrier plate, and the conductor to be switched is also plugged directly onto the carrier plate. To connect a conductor, a corresponding contact region is constructed on the carrier plate. Thus, when the carrier plate is manufactured, a decision has to be made as to how many conductors are to be switched by way of the carrier plate using a relay. Since construction of a corresponding terminal region gives rise to additional costs, when the carrier plate is manufactured, the number of terminal positions is minimized. Once the carrier plate has been manufactured, the number of conductors to be switched by the carrier plate is fixed, leaving no possibility for expansion.

SUMMARY OF THE INVENTION

An object of the invention is to provide a carrier plate having increased flexibility for later expansion of conductors to be switched, a plug-in module for connecting a conductor to the carrier plate, and a relay arrangement having a carrier plate and a plug-in module.

This and other objects are achieved by an improved plug-in module, a carrier plate and a relay arrangement.

The carrier plate has holding devices for a plug-in module for connecting conductors to be switched by a relay. The holding device is of simple and low-cost construction, allowing for expansion in the number of conductors to be switched.

The plug-in module has a holding element for mounting to a carrier plate, preferably in detachable manner. Furthermore, the plug-in module has a first terminal element for a conductor and a second terminal element for a relay conductor. The use of the plug-in module means that the number of conductors to be switched on a carrier plate can be expanded in a simple way.

Preferably, the plug-in module also has a plug position for a fuse. Thus, the fuse is also positioned off the carrier plate. This offers the advantage that the costs per plug position can be controlled once the number of conductors is determined. Furthermore, the arrangement of the fuse on the plug-in module offers the advantage that a defective fuse is directly coupled to a conductor to be switched.

BRIEF DESCRIPTION OF THE DRAWINGS

The invention will be explained in more detail below with reference to the figures, in which.

DETAILED DESCRIPTION OF THE PREFERRED EMBODIMENT

Figure 1:
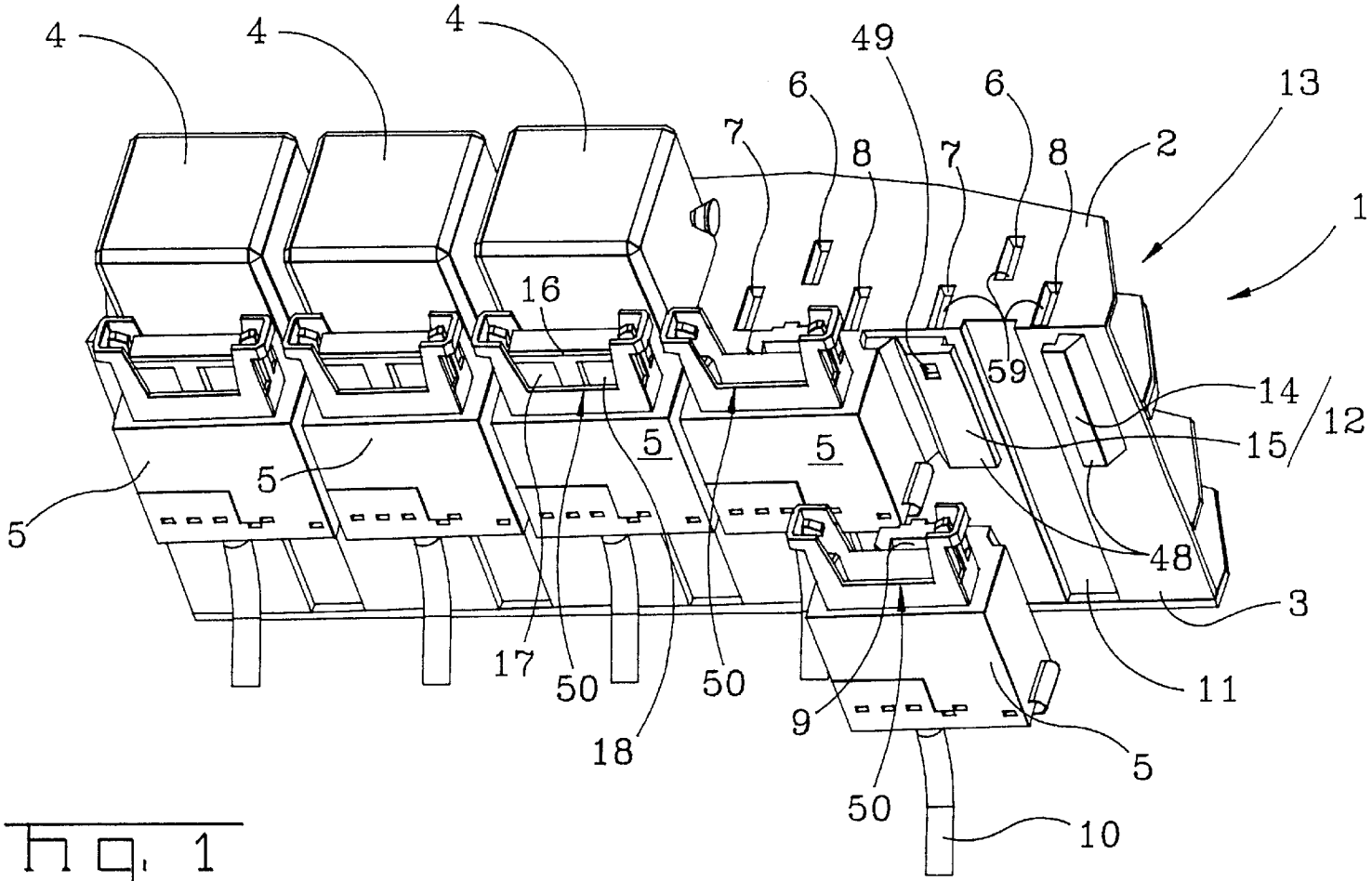
FIG. 1 is a perspective view showing part of a carrier plate with a relay and plug-in modules.

FIG. 1 shows part of a relay box 1 having a carrier plate 2. The relay box 1 serves to connect electrical conductors to a relay 4. The relay box 1 houses a carrier for the relay signal conductors and control conductors which are to be switched. A relay box housing has the carrier plate 2 positioned on an upper side and connected to a side wall 3. Further side walls and housing parts of the relay box are not explicitly illustrated. The carrier plate 2 has plug openings 6, 7, 8 for receiving plug contacts of a relay 4. In each of the plug openings 6, 7, 8 there is arranged an electrical receptacle contact 59 which is in turn connected to electrical conductors.

Figure 11:
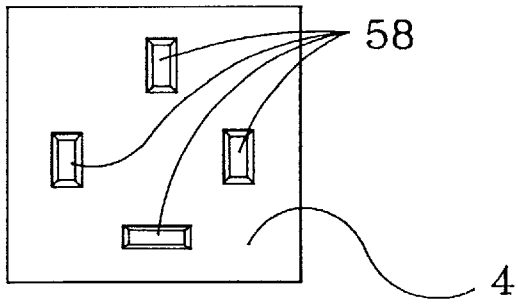
FIG. 11 is a bottom view of a relay.

On the left side of the carrier plate are illustrated three relays 4, plugged into three corresponding plug openings 6, 7, 8. The plug openings 6, 7, 8 are preferably arranged perpendicular to the edge of the carrier plate 2 which is joined to the side wall 3. In the embodiment described, each relay 4 has four contact pins 58 (FIG. 11). Three of these contact pins 58 are plugged into the plug openings 6, 7, 8 and hence into the associated receptacle contacts. The three plug openings 6, 7, 8 are arranged on the carrier plate 2 to receive three respective contact pins 58 of the relay 4. While the fourth plug opening 9 is located in a plug-in module 5 for receiving a fourth contact pin 58 of the relay 4. The plug-in module 5 is detachably mounted to the relay box 1.

The three plug openings 6, 7, 8 are arranged near the side wall 3. The side wall 3 has a mount 12 in the form of a first and a second retaining member 14, 15. The first and second retaining members 14, 15 are each constructed in the form of an elongate angled holding strip. The first and the second retaining members 14, 15 are angled with respect to each other and project from the side wall 3 at a predetermined spacing, so that two opposing holding edges 48 are formed. The retaining member 15 has a latching cutout 49 for receiving a latching lug on the plug-in module 5. Between the first and the second retaining members 14, 15 the side wall 3 has a cutout 11 which is arranged parallel to and between the first and second retaining members 14, 15. Both the cutout 11 and the first and second retaining members 14, 15 are freely accessible from the upper side, so that a plug-in module 5 can be pushed into either the cutout 11 or the mount 12.

Provided next to one another on the carrier plate 2 are mounts 12 which are arranged next to one another for receiving a plurality of relays 4. Because of the advantageous arrangement of the plug contacts in the region of the edge where the carrier plate 2 meets the side wall 3, a compact arrangement of the relays 4 with the plug-in modules 5 is possible. A relay 4 has all four contact pins 58 (FIG. 11) on an underside and, when a relay 4 is plugged in, these are arranged in the direction of the carrier plate 2.

However, at least one contact pin 58 is arranged next to the carrier plate 2 and is plugged into a fourth plug opening 9 in a plug-in module 5.

The plug-in module 5 has a rear side which is secured in the mount 12. Provided on an upper side of the plug-in module 5 is a fuse mount 50 which serves to hold a fuse 16. The fuse mount 50 is freely accessible from above the fourth plug opening 9 located between the fuse mount 50 and the rear side of the plug-in module 5. The fourth plug opening 9 is preferably arranged with the longitudinal side parallel to the rear side of the plug-in module 5. Similarly, the fuse mount 50 is preferably arranged on the upper side, parallel to the side edge of the rear side of the plug-in module 5. Because of the preferred arrangement of the fuse mount 50 and the fourth plug opening 9, a compact structure of the plug-in module 5 is possible with a small surface area on the upper side. Furthermore, the arrangement of the fuse mount 50 on the upper side of the plug-in module 5 offers the advantage that it is easily discernible which fuse 16 belongs with which relay 4.

Opposite the upper side, on an underside of the plug-in module 5, a conductor 10 is connected to the plug-in module 5. Preferably, the longitudinal side of the fourth plug opening 9 is not arranged parallel to the longitudinal sides of the first, second and third plug openings 6, 7, 8, to prevent incorrect insertion of the relay 4. It goes without saying that the contact pins associated with the plug openings 6, 7, 8, 9 are also arranged in the corresponding orientation. In the embodiment described, the second and third plug openings 7, 8 are used to connect control conductors to the relay 4. The first plug opening 6 and the fourth plug opening 9 are used as terminals for a signal conductor to be switched. The relay 4 serves as a switch which closes or opens the conductor to be switched (completes or opens the circuit) by way of the first and fourth plug openings 6, 9, in dependence on the control signals.

Figure 2:
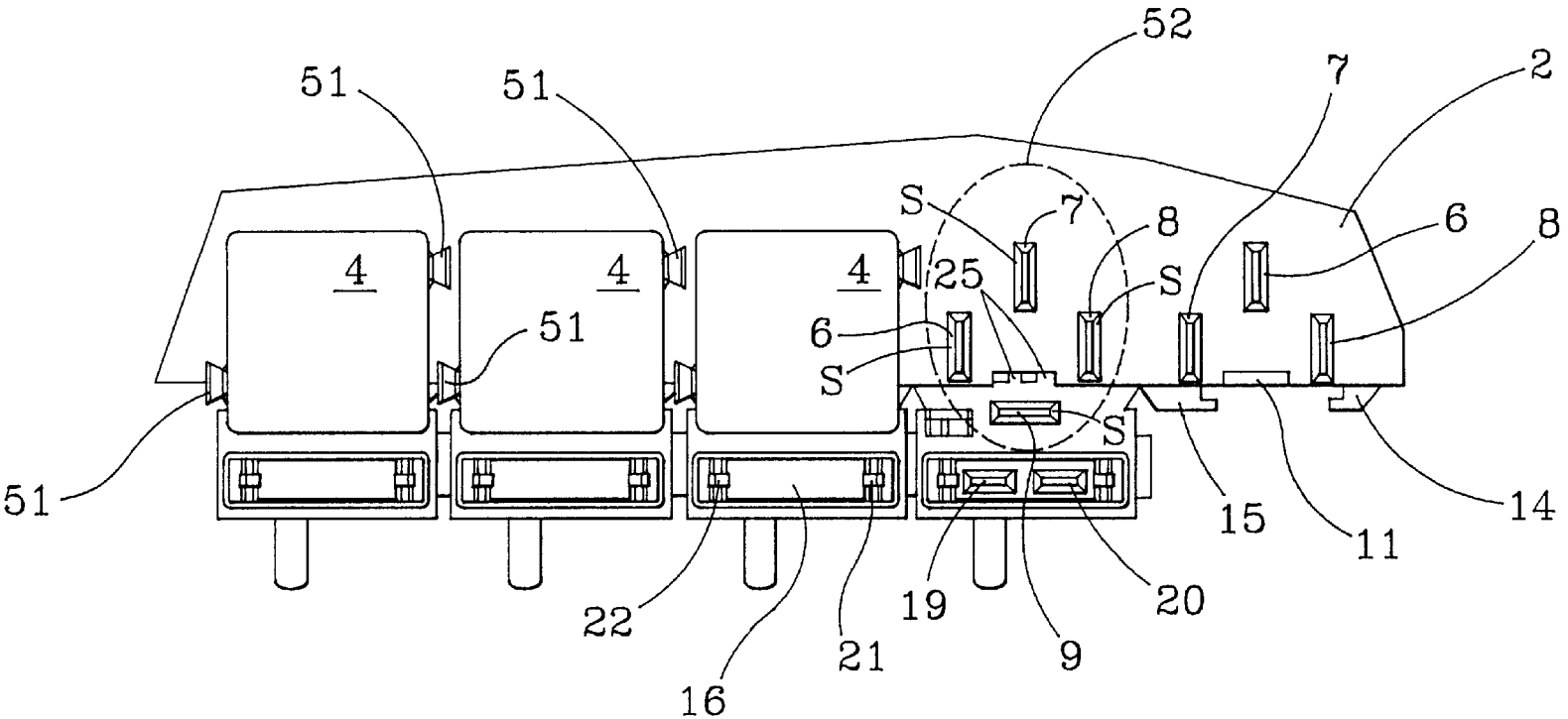
FIG. 2 is a top view showing the carrier plate with plug-in modules and the relay.

FIG. 2 shows a view from above of the carrier plate 2. A first and a second retaining member 21, 22 of the fuse mount 50 are arranged opposite one another at a predetermined spacing. The retaining members 21, 22 have on the mutually facing sides latching hooks which hold a fuse 16 firmly after it has been pushed into the fuse mount 50 from above.

Between the retaining members 21, 22 are a fifth and a sixth plug opening 19, 20 which are arranged with their longitudinal sides corresponding to the longitudinal side of the fuse mount 50. The fifth and sixth plug openings 19, 20 serve to receive a first and a second fuse contact 17, 18 of a fuse 16. A fuse 16 is pushed from above, with the first and second fuse contacts 17, 18 forward, into the fuse mount 50 and the correspondingly associated fifth and sixth plug openings 19, 20. In so doing, the fuse 16 is pushed in far enough for the fuse 16 to be held firmly in a seated position by the first and second retaining members 21, 22.

Furthermore, the shape, angled in cross-section, of the first and second retaining members 14, 15 and the central adjustment of the cutout 11 between the first and second retaining members 14, 15 are clearly visible.

The relays 4 have two diametrically arranged spacers 51 on two opposing side faces. The arrangement of the spacers 51 is selected to ensure correct insertion of the relay 4 into the plug openings of the carrier plate 2 and into the plug opening of the plug-in module 5. In FIG. 2, a plug opening arrangement 52 used for plugging in a single relay 4 is encircled by a dashed line. For each relay 4, a corresponding plug opening arrangement 52 is provided, with the plug opening arrangements 52 being arranged next to one another near an edge of the carrier plate 2.

Figure 3:
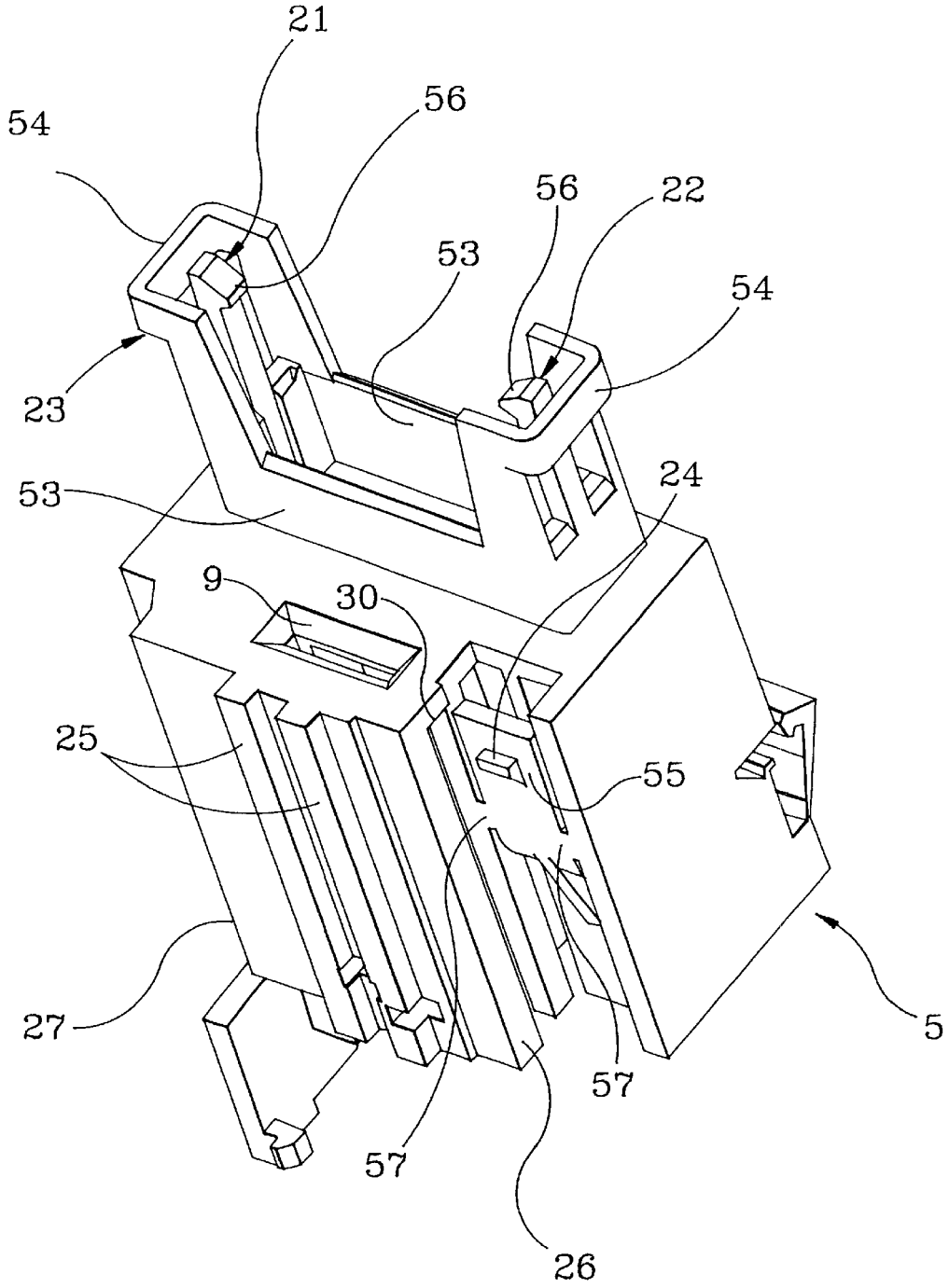
FIG. 3 is a rear perspective view showing a plug-in module from the rear.

FIG. 3 shows a perspective view of the rear side of the plug-in module 5. Here, the shape of the first and second retaining members 21, 22 can clearly be seen. Each retaining member 21, 22 has at the upper end a latching hook 56 for receiving a fuse 16. The two retaining members 21, 22 are surrounded by a protective frame 23. The protective frame 23 has raised protective elements 54 in the region of the first and second retaining members 21, 22 which are extended beyond the retaining members 21, 22. Between the retaining members 21, 22, the protective frame 23 has connection web 53. The preferred embodiment of the protective frame 23 makes it possible to mount and remove the fuse 16 simply and yet ensures that the retaining members 21, 22 are screened, so that inadvertently detaching the fuse 16 or damaging the retaining members 21, 22 is prevented.

Two mutually parallel rails 25 are constructed on the rear side of the plug-in module 5 near the fourth plug opening 9. The rails 25 run substantially parallel to a longitudinal axis of the plug-in module 5. The rails 25 serve to guide and orient the plug-in module 5 in the cutout 11. The position of the rails 25 when a plug-in module 5 is pushed in can clearly be seen in FIG. 2.

Furthermore, the plug-in module 5 has first and a second rails 26, 27 located on the side edges of the rear side facing opposite one another. When the plug-in module 5 is pushed into the mount 12, the first and second rails 26, 27 are pushed into the region delimited by the first and second angled retaining members 14, 15. The lateral spacing between the first and second holding rails 26, 27 are matched to the spacing between the first and second retaining members 14, 15. In the upper region, the first and second holding rails 26, 27 have a stop wall 30 which lies on the upper side of the first and second retaining members 14. The position of the stop wall 30 establishes the vertical position of a plug-in module 5 when plugged into the carrier plate 2. Furthermore, a latching lug 24 which latches into the latching cutout 49 (FIG. 1) is constructed in the top right-hand region of the rear side of the plug-in module 5. The plug-in module 5 is detached by urging a flexible tab 55 on which the latching lug 24 is formed away from the latching cutout 49. The flexible tab 55 is connected to the housing of the plug-in module 5 by connection webs 57.

Figure 4:
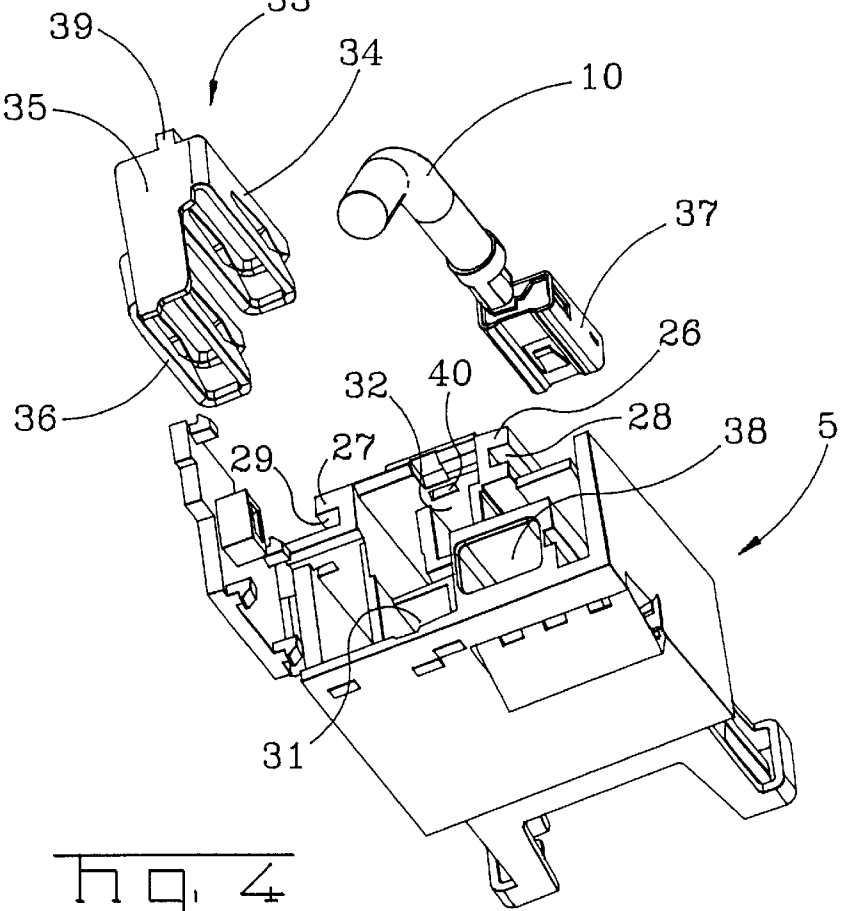
FIG. 4 is a bottom perspective view showing a plug-in module with a bridge clamp and an electrical conductor.

FIG. 4 shows a view of the underside of the plug-in module 5, with a first and a second holding cutout 28, 29 formed by the first and second holding rails 26, 27 being clearly visible. When the plug-in module 5 is fixed to the carrier plate 2, the angled longitudinal edges of the first and second retaining members 14, 15 are pushed into the first and second holding cutouts 28, 29 respectively. Furthermore, a cable opening 38 for receiving a plug connector 37 is provided on the underside of the plug-in module 5. An electrical conductor 10 is connected to the plug connector 37. Furthermore, a first and a second clamp opening 31, 32 are provided on the underside for receiving a bridge clamp 33. The bridge clamp 33 has a first and a second clamping arm 34, 36, being electrically connected to one another by a rear connection plate 35. The first and second clamping arms 34, 36 and the connection plate 35 are made from an electrically conductive material. The housing of the plug-in module 5 and the relay box 1 are made from an electrically insulating material. The first and second clamp arms 34, 36 each have two opposing double clamps. A latching lug 39 projects from a short transverse side of the connection plate 35. When the bridge clamp 33 is pushed into the first and second clamp openings 31, 32, the latching lug 39 engages in a latching cutout 40 on the inside of the housing. In this way, the bridge clamp 33 is securingly latched. Corresponding fixing means are also constructed on the plug connector 37 and the inner wall of the cable opening 38 in order to connect the plug connector 37 firmly to the plug-in module 5.

Figure 5:
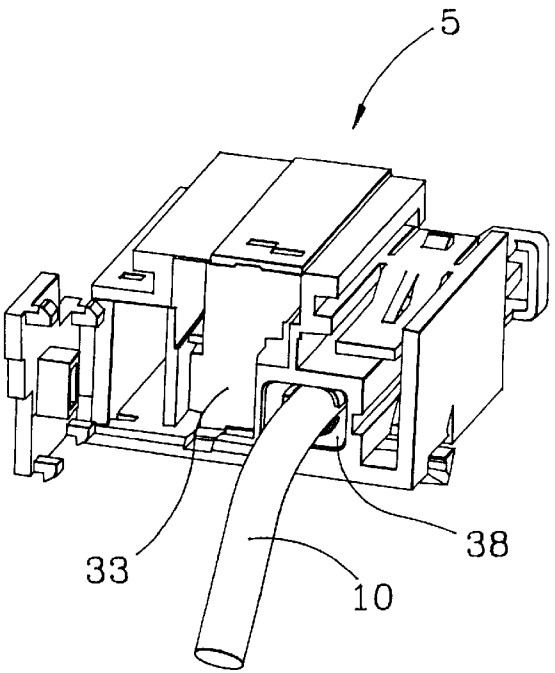
FIG. 5 is a perspective view showing a plug-in module with a plugged-in bridge clamp and a plugged-in conductor.

FIG. 5 shows the plug-in module 5 with the bridge clamp 33 plugged in and the plugged-in plug connector 37 with the electrical conductor 10.

Figure 6:
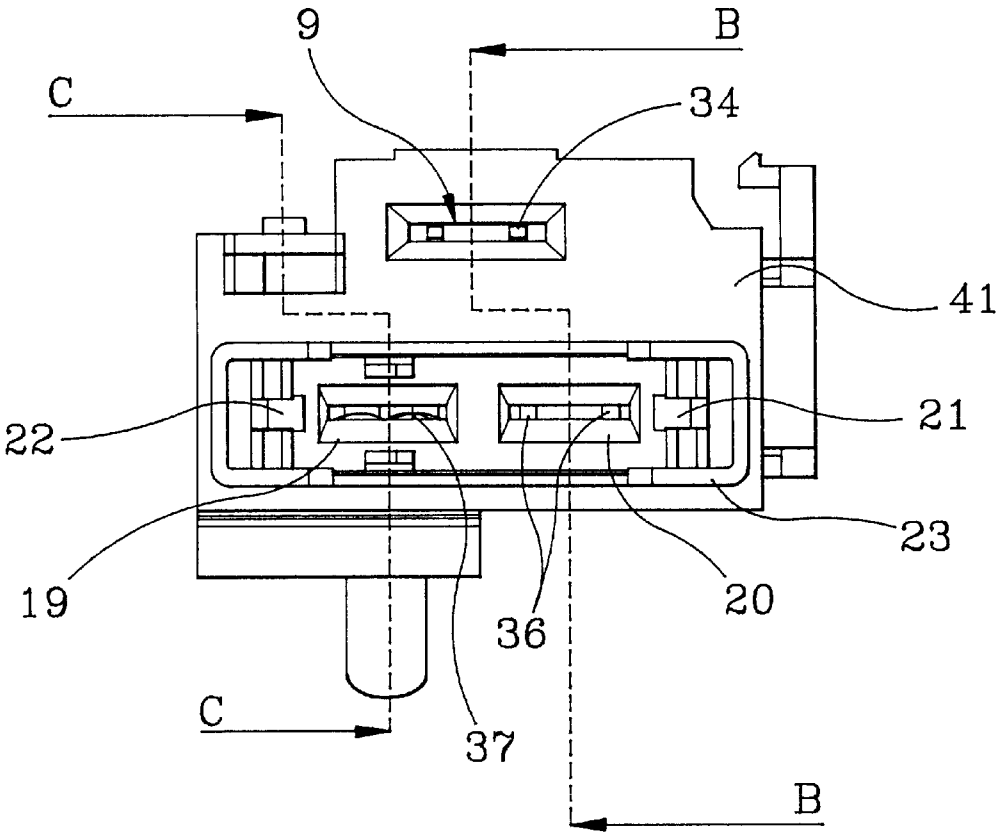
FIG. 6 is a top view of the plug-in module.

FIG. 6 shows the upper side of the plug-in module 5 in an enlarged illustration. The first clamping arm 34 of the bridge clamp 33 is illustrated diagrammatically in the fourth plug opening 9. A contact pin of the relay 4, which is plugged into the fourth plug opening 9, is received by the first clamping arm 34 to form an electrical connection. Furthermore, the second clamping arm 36 can be seen diagrammatically in the sixth plug opening 20. If a fuse with a second fuse contact 18 is pushed into the fuse mount 50, then the second fuse contact 18 is grasped by the second clamping arm 36 to form an electrical contact between the bridge clamp 33 and the second fuse contact 18. Furthermore, the plug connector 37 can be seen in the fifth plug opening 19. When a fuse 16 is plugged in, the plug connector 37 receives the first fuse contact 17 and makes an electrical connection between the conductor 10 and the first fuse contact 17.

Figure 7:
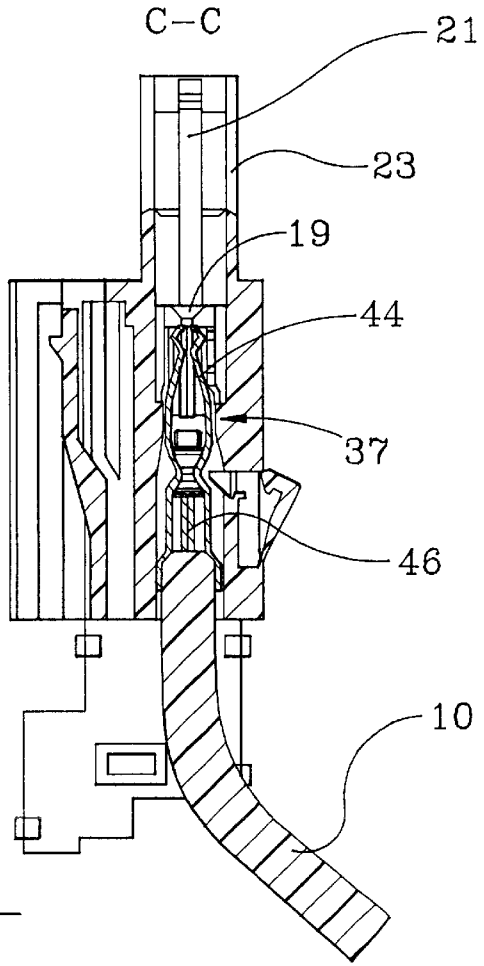
FIG. 7 is a cross-sectional view taken along the line C—C of FIG. 6.

In FIG. 7, the electrical contact is clearly shown between the electrical conductor 10, with a conductor 46, and a first contact 44. The first contact 44 is arranged in the plug connector 37. Above the first contact 44 in the housing of the plug-in module 5, the fifth plug opening 19 is illustrated The first contact 44 comprises two contact arms which are pre-tensioned toward each other and form a funnel-like receiving region corresponding with the fifth plug opening 19.

Figure 8:
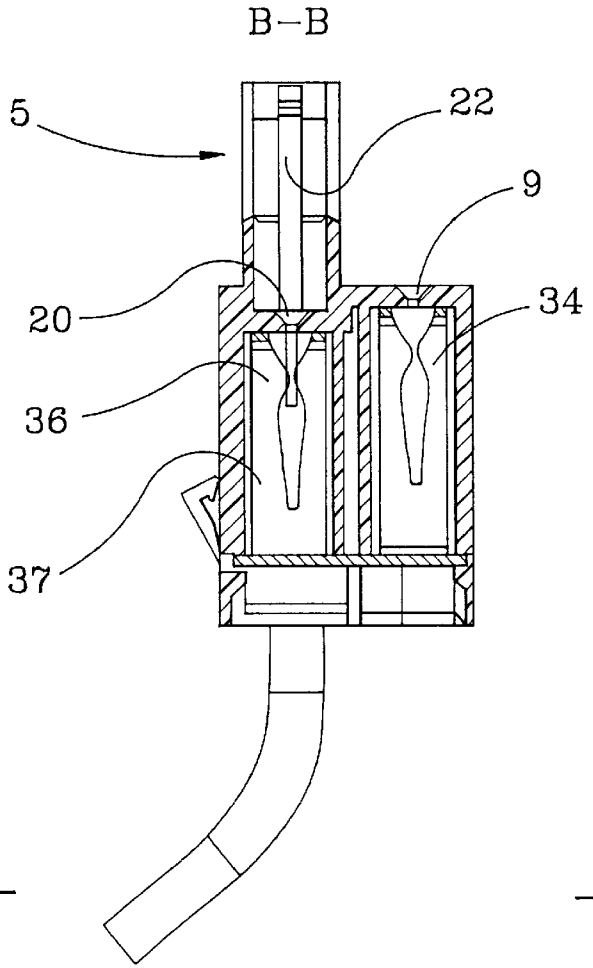
FIG. 8 is a cross-sectional view taken along the line B—B of FIG. 6.
Figure 9:
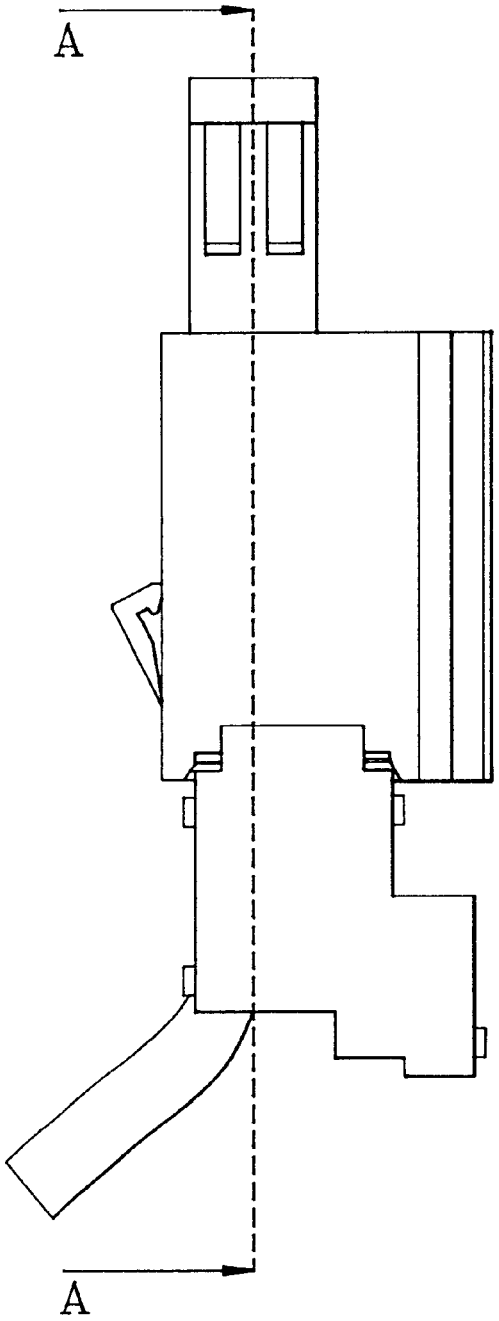
FIG. 9 is a side view of the plug-in module.

In FIG. 8, the arrangement of the first and second contact arms 34, 36 of the bridge clamp 33 can clearly be seen. The first contact arm 34 is associated with the fourth plug opening 9 and the second contact arm 36 is associated with the fifth plug opening 20.

Figure 10:
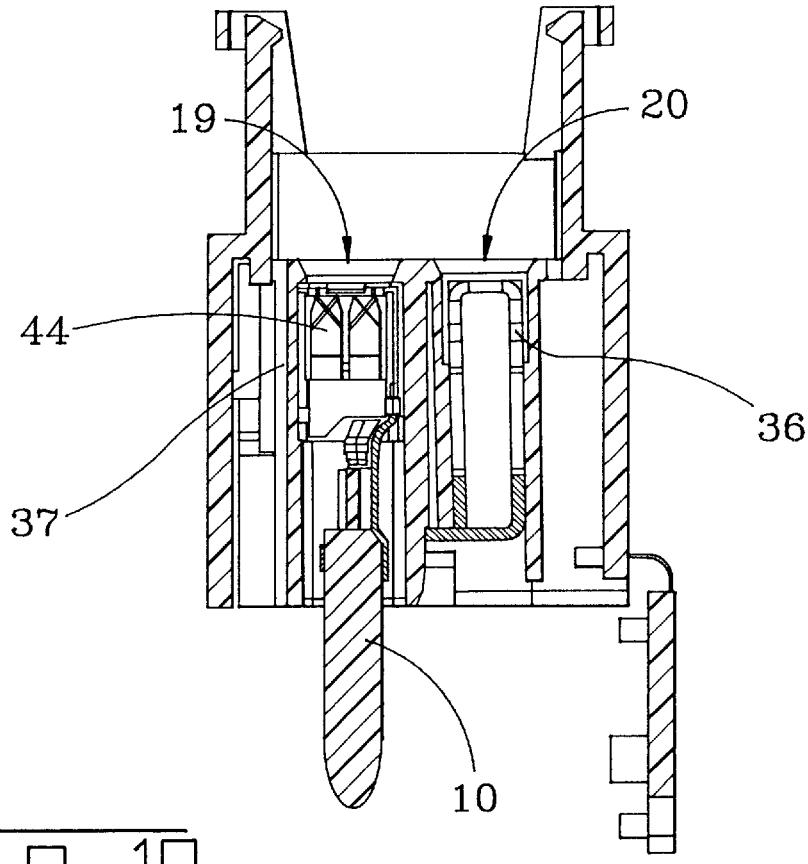
FIG. 10 is a cross-sectional view taken along the line A—A of FIG. 9.

In FIG. 10, once again a cross-section through the fifth and sixth plug openings 19, 20 is illustrated. Here, it can be seen that the first contact 44 is composed of two opposing spring arms.

When a plug-in module 5 is plugged onto the carrier plate 2 and a relay is plugged into both the carrier plate 2 and the plug-in module 5, the conductor 10 to be switched is connected through the fifth plug opening 19, the fuse 16, the sixth plug opening 20, the bridge clamp 33 and the fourth plug opening 9 to a contact pin of the relay 4. The relay 4 preferably has as the input to the conductor to be switched by a plug contact which is associated with the second plug opening 7. The first and third plug openings 6, 8 are used to feed control signals and preferably a control voltage to the relay.

FIG. 11 shows a relay 4 from the underside, with four contact pins 58 which project downwards out of the relay 4.

An advantage of the invention consists in setting at least one electrical terminal of a relay outside a carrier plate. The missing electrical terminal is constructed on a plug-in module 5 which is detachably connected to the carrier plate 2.

What is claimed is:

1. A plug-in module, comprising:

a first terminal element for a conductor;

a second terminal element for a relay;

a holding element which serves to mount the plug-in module on a carrier plate; and, the second terminal element is accessible by a plug opening and the holding element is formed such that the plug opening is positioned adjacent to corresponding plug openings on the carrier plate;

wherein a plug position for a fuse is provided, the plug position has receivers for two contacts of the fuse, and the first terminal element is electrically connected to a first contact and the second terminal element is electrically connected to a second contact of the fuse.

2. A plug-in module according to claim 1 wherein the second terminal element is accessible from an upper side of the plug-in module by way of the plug opening, and the holding element is constructed on a side wall of the plug-in module.

3. A plug-in module according to claim 2 wherein the plug position is arranged on the upper side of the plug-in module.

4. A plug-in module according to claim 3 wherein the plug position is arranged with a longitudinal side parallel to a longitudinal side of the plug-in module.

5. A plug-in module according to claim 4 wherein the longitudinal side of the plug opening is arranged substantially parallel to a side edge of the plug-in module.

6. A plug-in module according to claim 5 wherein the first terminal element is accessible from an underside of the plug-in module by way of a cable opening, and in that the underside is arranged opposite the upper side.

7. A plug-in module according to claim 6 wherein the holding element is arranged on a side wall of the plug-in module, the holding element has parallel holding rails arranged substantially perpendicular to the upper side of the plug-in module.

8. A plug-in module according to claim 7 wherein the plug-in module has a guide rail, and the guide rail serves to align the plug-in module on an adjusting element of a carrier plate.

9. A plug-in module according to claim 8 wherein a latching lug is arranged on a side wall of the plug-in module, and the latching lug is arranged laterally with respect to two holding rails arranged on the same side wall as the latching lug.

10. A plug-in module, comprising:

a first terminal element for a conductor;

a second terminal element for a relay;

a holding element which serves to mount the plug-in module on a carrier plate;

a plug position for a fuse, the plug position has receivers for two contacts of the fuse, and the first terminal element is electrically connected to a first contact and the second terminal element is electrically connected to a second contact of the fuse;

the second terminal element is accessible from an upper side of the plug-in module by way of a plug opening, and the holding element is constructed on a side wall of the plug-in module;

the plug position is arranged on the upper side of the plug-in module; the plug position is arranged with a longitudinal side parallel to a longitudinal side of the plug-in module, the longitudinal side of the plug opening is arranged substantially parallel to a side edge of the plug-in module;

the first terminal element is accessible from an underside of the plug-in module by way of a cable opening, the underside is arranged opposite the upper sides;

the holding element is arranged on a side wall of the plug-in module, the holding element has parallel holding rails arranged substantially perpendicular to an upper side of the plug-in module;

the plug-in module has a guide rail, and the guide rail serves to align the plug-in module on an adjusting element of a carrier plate;

a latching lug is arranged on a side wall of the plug-in module, and the latching lug is arranged laterally with respect to two holding rails arranged on the same side wall as the latching lug; and, the plug-in module has two openings on an underside, a contact bridge is pushed into the two openings, the contact bridge has two clamping arms which are connected to one another by way of a connection plate, a clamping arm is associated in each case with a respective opening, and a first clamping arm is arranged on the second terminal element and a second clamping arm is arranged on the first terminal element.

11. A plug-in module according to claim 10 wherein the holding rails delimit holding cutouts which are open from an underside of the plug-in module, and at least one holding rail has in the upper region close to the upper side, a stop wall which limits pushing on of the plug-in module to one mounting.

12. A relay arrangement, comprising:

a carrier plate;

a plug-in module which is detachably connected to the carrier plate, the plug-in module having a first terminal element for a conductor and a plug position for a fuse; and, a relay with contact pins, at least one of the contact pins being plugged into the plug-in module and at least one of the contact pins being plugged into the carrier plate.

13. The relay arrangement of claim 12, wherein the conductor is electrically connected to the contact pin of the plug-in module through the fuse.

14. The relay arrangement of claim 13, wherein the fuse is electrically connected to the contact pin of the plug-in module through a contact bridge.

* * * * *